US006089661A

United States Patent [19]

Åström

[11] Patent Number: 6,089,661

[45] Date of Patent: Jul. 18, 2000

[54] CHAIR

[76] Inventor: Anette Åström, Graänsgatan 12 E, S-972 32 Luleå, Sweden

[21] Appl. No.: 09/011,802

[22] PCT Filed: Aug. 9, 1996

[86] PCT No.: PCT/SE96/00999

§ 371 Date: Apr. 15, 1998

§ 102(e) Date: Apr. 15, 1998

[87] PCT Pub. No.: WO97/06714

PCT Pub. Date: Feb. 27, 1997

[30] Foreign Application Priority Data

Aug. 15, 1995 [SE] Sweden ..... 9502838

[51] Int. Cl.[7] ..... A47G 15/00

[52] U.S. Cl. ..... 297/237; 297/236; 297/338; 182/33.2

[58] Field of Search ..... 182/33, 33.2, 33.5, 182/33.6; 297/338, 256.11, 237, 236, 234

[56] References Cited

U.S. PATENT DOCUMENTS

| | | | |
|---|---|---|---|
| 190,027 | 4/1877 | Goffette | 182/33.2 |
| 511,837 | 1/1894 | Eggert | 182/33.2 X |
| 1,277,682 | 9/1918 | Belanger | 297/237 X |
| 1,283,999 | 11/1918 | Weakley | 297/237 |
| 1,663,960 | 3/1928 | Sweigard | 182/33.2 |
| 1,950,591 | 3/1934 | Bing | 182/33.2 |
| 2,433,699 | 12/1947 | Keen | 182/33.5 |
| 2,963,076 | 12/1960 | Hyman | 182/33 |
| 4,109,961 | 8/1978 | Opsvik | 297/338 |

FOREIGN PATENT DOCUMENTS

| | | | |
|---|---|---|---|
| 1014760 | 6/1952 | France | 182/33.5 |
| 0156837 | 9/1984 | Japan | 297/237 |
| 156836 | 9/1984 | Japan | 297/237 |
| 2006617 | 5/1979 | United Kingdom | 297/338 |

*Primary Examiner*—Peter M. Cuomo
*Assistant Examiner*—David E. Allred
*Attorney, Agent, or Firm*—Pillsbury Madison & Sutro LLP

[57] ABSTRACT

A chair that can be adapted for use as a child's chair has a bottom part (1) which carries a seat (2) and a back rest (3). The seat (2) is comprised of a first fixed part (4) and a second part (5) which is hinged to the fixed part such as to enable the second part to be raised from a normal state of use of the chair in which its seating surface (6) is located forwardly of and in the plane of the seating surface (7) of the first part (4), to a position in which the seating surface (6) of the first part rests on the seating surface (7) of the first part (4). The underside of the second part (4) includes a further seating surface (9) which when the second part is raised is located above and spaced from the seating surface (6) of the second chair-part (5).

6 Claims, 2 Drawing Sheets

CHAIR

This application is the national phase of international application PCT/SE96/00999 filed Aug. 9, 1996 which designated the U.S.

The present invention relates to a chair which can be used as a child's chair, in accordance with the preamble of claim 1.

Many different designs of children's chairs are known to the art. A very common type of children's chair is the so-called high chair which is placed in direct contact with the floor and which seats a child at a convenient level in relation to a standard table. Another relatively usual type of chair is one which is intended to be fitted onto the seat of a standard chair, preferably a kitchen chair, and therewith raise the child to a convenient height. The drawback with children's chairs of this kind is that they can be used solely for children. There is thus a need for a chair which resembles a traditional chair, preferably a kitchen chair, and which can be readily converted into a children's chair having a raised seating surface so that a child will be seated at a convenient height in relation to a standard table. In view of rising living costs, there is a need of furniture that is able to fulfil several different functions and that can be used for different purposes; c.f. compact living.

Accordingly, the object of the invention is to avoid the drawbacks of hitherto known chairs and to provide a chair which can be used both by children and adults. The chair will also preferably be constructed to enable a child to climb into and descend from the chair more easily. Another advantage afforded by this construction is that the inventive chair can also be used as a step chair.

This object is achieved with an inventive chair having the characteristic features set forth in the following claims.

The inventive chair constructed in accordance with the illustrated embodiment also has the advantage of including a back rest which can be used even when the chair is used as a children's chair. In order to enable the raised seating surface of the inventive chair to be adapted to the natural growth of a child with time, the seating surface is preferably adapted for vertical adjustment. This is achieved by virtue of mutually opposing grooves disposed at different heights in the wall portions of the pivotal part, whereby the seating surface can be inserted into and withdrawn from respective appropriate grooves and locked in its inserted position.

Figure 1:
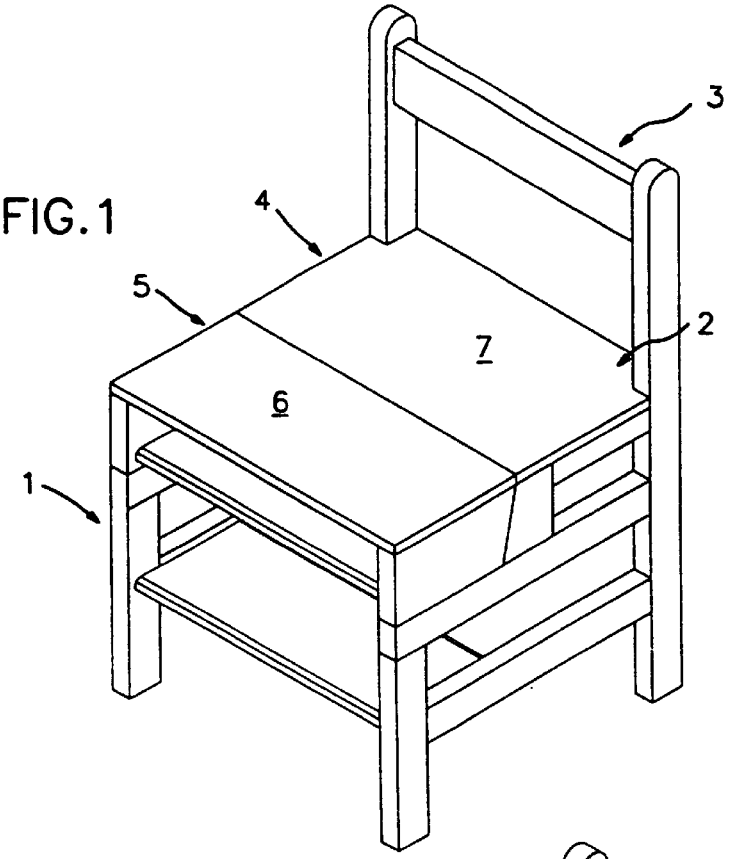
Figure 2:
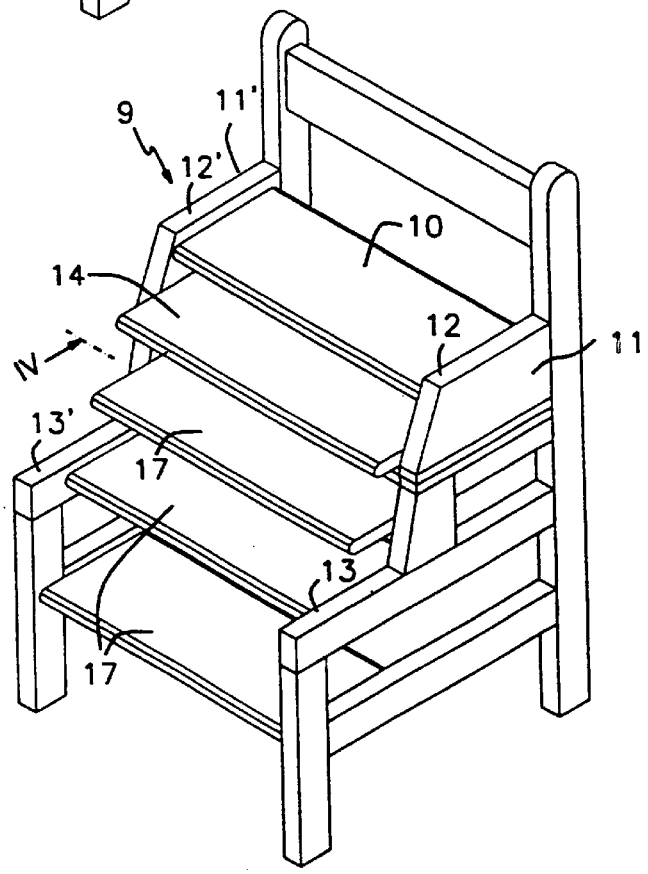
Figure 3:
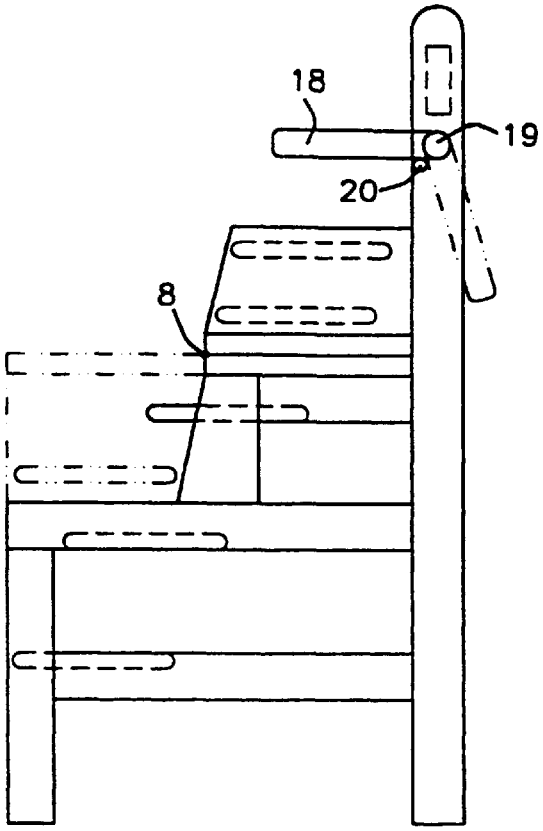
Figure 4:
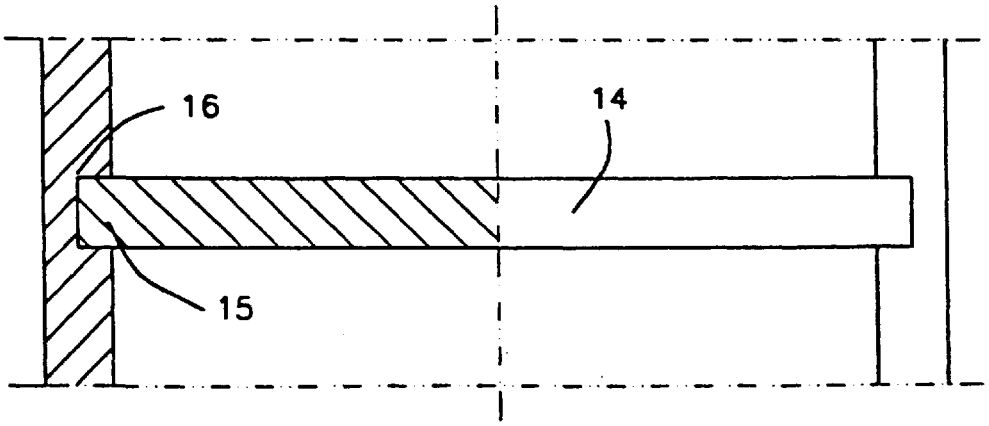

The invention will now be described in more detail with reference to an exemplifying embodiment thereof and also with reference to the accompanying drawings, in which FIG. 1 is a perspective view of an inventive chair in its normal use state; FIG. 2 is a perspective view of an inventive chair when the chair is used as a children's chair; FIG. 3 is a schematic side view of the inventive chair provided with a supporting arch; and FIG. 4 is a part view and partially sectioned view from the front of the chair shown in FIG. 2.

The drawings illustrate a traditional so-called kitchen chair which is preferably assembled by dowelling and gluing together wooden chair components, wherein the illustrated chair includes a bottom part 1 which carries a seat 2 and a back rest 3. According to the invention, the seat 2 is divided into a first fixed part 4 and a second part 5 which is hinged to the fixed part such as to enable said second part 6 to be swung from a standard chair position (FIG. 1) in which the seating surface 6 of said second part is located forwardly and in the plane of the seating surface 7 of the first part 4, to a position (FIG. 2) in which the seating surface 6 rests on the seating surface 7 of the first part 4. As indicated in FIG. 3, this pivotal movement of the second part is effected through the medium of an elongated piano hinge 8 fitted between the rear edge of the seating surface 6 of the second part 5 and the front edge of the seating surface 7 of the first part 4.

As will be evident from FIG. 2, the underside of the second seat-part 5 is provided with a further seating surface 9 in the form of a plate or slab 10 which is supported by two wall-parts 11, 11' on respective sides of the seating surface 6 of said second part 5, such that when the second part 5 is raised the plate 10 will be located above and spaced from the seating surface 6 of the second part 5. In the normal use position of the chair, i.e. when the second part 5 is lowered, the edge 12, 12' of respective wall-parts 11, 11' will rest on correspondingly configured abutment surfaces 13, 13' on the bottom chair-part 1. The wall-parts 11, 11' are spaced apart such that their outer surfaces will be located in the plane of the sides of the bottom chair-part, so as to give the chair a uniform appearance.

With the intention of providing a foot support for a child seated on the raised seating surface of the chair, the second part 5 includes a second plate or slab 14 which is supported by the opposing wall-parts and which is parallel with the first plate 10 forming the raised seating surface 9 of the chair, wherein when the second part 5 is raised, the second plate 14 will be conveniently spaced from the first plate 10.

To enable the plate 14 to be moved away as the second chair-part 5 is swung up and down, the edge-parts 15 of the second plate are accommodated in pairs of mutually opposing grooves 16 formed in the mutually opposite sides of the wall-parts 11, 11' of said second part 5, therewith enabling the second plate to be displaced transversely to the back rest, as shown in FIG. 4.

As will be seen from FIGS. 1–2, the bottom part 1 of the chair is provided with a number of steps comprising mutually parallel and mutually displaced plates 17 which are located at different heights and which are exposed when the second part 5 is raised. As will be seen from FIG. 2, the uppermost plate 17 of the step-forming plates lies within the area of movement of the second part 5. In order to enable the plate 17 to be moved away when swinging-up the second part 5, the edges of the plate 17 are received in pairs of mutually opposing grooves formed in the side-walls of the fixed chair-part, so as to enable the plate to be displaced transversely to the back rest (FIG. 4).

With the intention of preventing the displaceable plate 14 of the second part 5 from sliding out and therewith restrict the upwards and downwards pivotal movement of the second part, there is provided a latching device which locks the plate 14 in its out of the way bottom position (not shown in the Figures).

FIG. 3 shows the inventive chair provided with a support arch 18 which extends between the sides of the back rest and which is pivotally connected at its ends to said sides by a respective pivot pin 19 such as to enable the arch to swing between two positions. When the second seat-part 5 is raised and the inventive chair used as a children's chair, the support arch 18 will extend horizontally to provide support for the torso of the child seated in the chair. In this position, the bottom edge of the arch will be in abutment with a stop shoulder 20 provided on the side of the back rest. When the second part 5 is lowered and the chair not used as a children's chair, the support arch 18 will normally be located in its second position out of the way behind the chair back rest.

It will be understood that the invention is not restricted to the aforedescribed and illustrated embodiment and that changes and modifications can be made within the scope of the inventive concept as defined in the following claims. For instance, the inventive principles can be applied in all fields where a raised seating surface is desired, for instance in cinemas, aircraft, automobiles, boats, etc.

What is claimed is:

1. A chair that can be adapted for use as a child's chair, comprising a bottom part (1) having a seat (2) and a back rest (3), wherein the seat (2) is comprised of a first fixed part (4) and a second part (5) comprising a plurality of rigid plates capable of forming at least one step and a seating surface (6) and further comprising lowermost edges (12, 12') below an upper surface of a said seating surface (6) which is hinged to the first fixed part (4) such as to enable said second part (5) to be raised from a first position in which its seating surface (6) is located forwardly of and coplanar with a seating surface (7) of the first fixed part (4), to a second position in which the seating surface (6) of the second part (5) rests on the seating surface (7) of the first fixed part (4); and in that an underside of the second part (5) includes said lowermost edges (12, 12'), at least one said step and a further seating surface (9) which, when the second part (5) is raised to the second position, are located above the seating surface (7) of the first fixed part (4), wherein said lowermost edges (12, 12') engage said back rest (3) at an intermediate position between said seating surface (7) of the first fixed part (4) and a top surface of said back rest (3), so as to define said back rest for said child's chair.

2. A chair according to claim 1, wherein the further seating surface (9) is formed by a first of said rigid plates (10) which is carried between lowermost edges (12, 12').

3. A chair according to claim 1, characterized in that the bottom part (1) has a number of plates (17) which are disposed at mutually different heights and offset in relation to one another such as to form a series of steps.

4. A chair according to claim 2, further comprising a second plate (14) which is supported between the lowermost edges (12, 12' of the second part (5) and is located beneath and spaced from the first plate (10) when the second part (5) is in the second position such as to form a child's foot support.

5. A chair according to claim 4, characterized in that the second plate (14) is displaceable in a direction transverse to a plane of the back rest (3), said second plate (14) being movable in said direction so as to provide a clearance for pivotal movement of the second part (5).

6. A chair according to claim 1, characterized in that the back rest (3) includes a support arch (8) which extends between sides of the back rest and the ends of which are pivotally connected to said sides in a manner to enable the arch to be swung between two positions, wherein in a first position the arch forms a support for the torso of a child seated in the chair, and in a second position is located behind the back rest.

* * * * *